US007681254B2

(12) United States Patent
Lambertz

(10) Patent No.: US 7,681,254 B2
(45) Date of Patent: Mar. 23, 2010

(54) SOCK HAVING ACHILLES TENDON PROTECTION

(75) Inventor: Bodo W. Lambertz, Pfäffikon (CH)

(73) Assignee: X-Technology Swiss GmbH, Wollerau (CH)

( * ) Notice: Subject to any disclaimer, the term of this patent is extended or adjusted under 35 U.S.C. 154(b) by 0 days.

(21) Appl. No.: 10/534,516

(22) PCT Filed: Nov. 11, 2003

(86) PCT No.: PCT/DE03/03778

§ 371 (c)(1),
(2), (4) Date: Oct. 10, 2006

(87) PCT Pub. No.: WO2004/043176

PCT Pub. Date: May 27, 2004

(65) Prior Publication Data

US 2007/0033710 A1 Feb. 15, 2007

(30) Foreign Application Priority Data

Nov. 11, 2002 (DE) ..... 202 17 332 U

(51) Int. Cl.
*A43B 17/00* (2006.01)
*A41B 11/00* (2006.01)

(52) U.S. Cl. ..... 2/239

(58) Field of Classification Search ..... 2/22, 2/239–242; 602/14, 23, 27, 65
See application file for complete search history.

(56) References Cited

U.S. PATENT DOCUMENTS 1,231,332 A * 6/1917 Collis ..... 602/65
2,582,648 A * 1/1952 Mowbray ..... 36/8.1
2,638,601 A * 5/1953 Bullard, III ..... 2/239
2,830,585 A * 4/1958 Weiss ..... 602/65
2,994,322 A * 8/1961 Cullen et al. ..... 602/27
3,003,154 A * 10/1961 Litman ..... 2/239
3,028,861 A * 4/1962 Shapiro ..... 602/65
3,506,000 A * 4/1970 Baker ..... 602/65
3,995,322 A * 12/1976 Chesebro, Jr. ..... 2/239
4,008,350 A * 2/1977 Crawford et al. ..... 521/54
4,476,858 A * 10/1984 Curtis ..... 602/23
4,631,755 A * 12/1986 Zingg et al. ..... 2/239
4,662,088 A * 5/1987 Autry et al. ..... 36/105
4,811,727 A * 3/1989 Etienne ..... 602/23
4,841,957 A * 6/1989 Wooten et al. ..... 602/27
5,092,347 A * 3/1992 Shaffer et al. ..... 128/892
5,133,088 A * 7/1992 Dunlap ..... 2/241
5,135,473 A * 8/1992 Epler et al. ..... 602/62
5,185,000 A * 2/1993 Brandt et al. ..... 602/63
5,211,672 A * 5/1993 Andujar ..... 36/106
5,464,384 A * 11/1995 Cromartie ..... 602/27

(Continued)

FOREIGN PATENT DOCUMENTS

DE 2547809 A * 4/1977

(Continued)

*Primary Examiner*—Alissa L Hoey
(74) *Attorney, Agent, or Firm*—Olson & Cepuritis, Ltd.

(57) ABSTRACT

This invention relates to a sock, in particular to be used of sporting activities, comprising cushioning in the vicinity of the Achilles tendon. Said cushioning is formed by at least two spacer cushion pads (24,25), placed on either side of the Achilles tendon and running alongside the latter.

14 Claims, 2 Drawing Sheets

U.S. PATENT DOCUMENTS

| | | | | | |
|---|---|---|---|---|---|
| 5,603,232 | A | * | 2/1997 | Throneburg | 66/185 |
| 5,620,413 | A | * | 4/1997 | Olson | 602/65 |
| 5,640,714 | A | * | 6/1997 | Tanaka | 2/22 |
| 5,717,996 | A | * | 2/1998 | Feldmann | 2/22 |
| 5,771,495 | A | * | 6/1998 | Turner et al. | 2/239 |
| 5,784,721 | A | * | 7/1998 | Huff | 2/239 |
| 5,830,237 | A | * | 11/1998 | Kania | 623/37 |
| 5,898,948 | A | * | 5/1999 | Kelly et al. | 2/240 |
| 6,021,527 | A | * | 2/2000 | Lessard | 2/239 |
| 6,022,332 | A | * | 2/2000 | Nelson | 602/27 |
| 6,286,151 | B1 | * | 9/2001 | Lambertz | 2/239 |
| 6,945,944 | B2 | * | 9/2005 | Kuiper et al. | 602/13 |
| 6,964,688 | B1 | * | 11/2005 | Kania | 623/36 |
| 7,014,621 | B2 | * | 3/2006 | Nelson | 602/27 |
| D580,557 | S | * | 11/2008 | Lin et al. | D24/192 |
| D581,057 | S | * | 11/2008 | Lin et al. | D24/192 |
| 2003/0167548 | A1 | * | 9/2003 | LaShoto et al. | 2/22 |
| 2003/0230121 | A1 | * | 12/2003 | Yokoyama | 66/178 A |
| 2004/0210988 | A1 | * | 10/2004 | Lambertz | 2/239 |

FOREIGN PATENT DOCUMENTS

| | | | | |
|---|---|---|---|---|
| DE | 10305277 | A1 | * | 9/2003 |
| DE | 10356817 | A1 | * | 7/2005 |
| EP | 562967 | A1 | * | 9/1993 |
| FR | 2607383 | A | * | 6/1988 |
| FR | 2808661 | A1 | * | 11/2001 |
| JP | 2003088545 | A | * | 3/2003 |

* cited by examiner

SOCK HAVING ACHILLES TENDON PROTECTION

CROSS-REFERENCE TO RELATED APPLICATION

This application is based upon patent application PCT/DE03/0370176 filed Nov. 11, 2003, International Publication No. WO 2004/043176.

BACKGROUND OF THE INVENTION

The invention relates to a sock, particularly for use in sporting activities, which has a cushion padding in the area of the Achilles tendon.

The human feet are, as a rule, accommodated inside solid footwear, particularly, in sporting activities. They are, in particular, frequently entirely surrounded by socks. Because of the numerous and rapid movements, an increased friction on the foot is brought about inside the shoe during sporting activities, which is connected with dynamic pushing stresses. The area of the projecting Achilles tendon is particularly affected by this. Because the edge of the body of the shoe, which is generally hard and is, depending on the footwear, applied to the Achilles tendon at different heights, this tendon can, in addition, be very greatly stressed by rubbing- and sliding effects, which act aggressively in a point-like manner. This can lead to a premature fatigue of the foot, as well as to grazing injuries, even to the point of injuries of the Achilles tendon.

In order to reduce the friction, as well as to reduce pushing movements, it is known to provide socks with a softly cushioned toe-, sole-, and heel area, among other points (compare: DE 87 01 834 U1). It is also known to protect the area of the Achilles tendon by providing a cushion pad (compare: DE 200 16 825.8). The known types of socks are not, however, able to keep the rubbing- and sliding stresses that appear away from the Achilles tendon to a sufficient degree.

Here, the invention is intended to provide help. The task that forms the basis of the invention is that of further improving the protection of the Achilles tendon by the socks. This task is solved, in accordance with the invention, through the fact that the cushion padding is formed by at least two spacer cushion pads, which are positioned on both sides of and along the Achilles tendon.

By means of the invention, a sock is created, particularly for sports activities, which further improves the protection of the Achilles tendon inside the shoe. Through the provision of two spacer cushion pads, which are positioned on both sides and along the Achilles tendon, a distance between the Achilles tendon and the shoe is achieved, as the result of which rubbing- and sliding stresses can be kept away from the Achilles tendon.

In a further development of the invention, a transition piece is inserted between the spacer cushion pads. The spacer cushion pads are held in an optimal position by the inserted transition piece.

In an additional implementation of the invention, the transition piece is designed in the form of a cushion pad, which has a smaller thickness than the spacer cushion pad. The protection of the Achilles tendon is additionally increased by the additional cushion padding of the transition piece. On the one hand, it is ensured, through the lesser thickness of the transition piece, that the spacer cushion pads reliably maintain their position on both sides of the Achilles tendon, even during extreme sporting activities. On the other hand, the Achilles tendon itself is additionally protected by the cushion padding of the transition piece against rubbing- and sliding stresses.

In another further development of the invention, the spacer cushion pads are adjusted in their form, in the area of the Achilles tendon, to the anatomical shape of the foot. By this means, the absorption of the dynamic pushing stresses is optimized by the cushion padding, and the strain on the Achilles tendon is minimized.

The sock is advantageously equipped with an X-cross bandage. The X-cross bandage supports the ankle in the transition area between the leg and the foot.

In the configuration in accordance with the invention, the sock has at least one air channel that extends from the cuff up to the weight-bearing area. This air channel optimizes the climate control for the foot inside the sock, and thus reduces the formation of sweat.

BRIEF DESCRIPTION OF THE DRAWING

One example of implementation of the invention is depicted in the drawings, and will be described in individual terms in the following, wherein like numerals refer to like elements in the various views and wherein.

DETAILED DESCRIPTION OF THE PRESENT INVENTION

Figure 1:
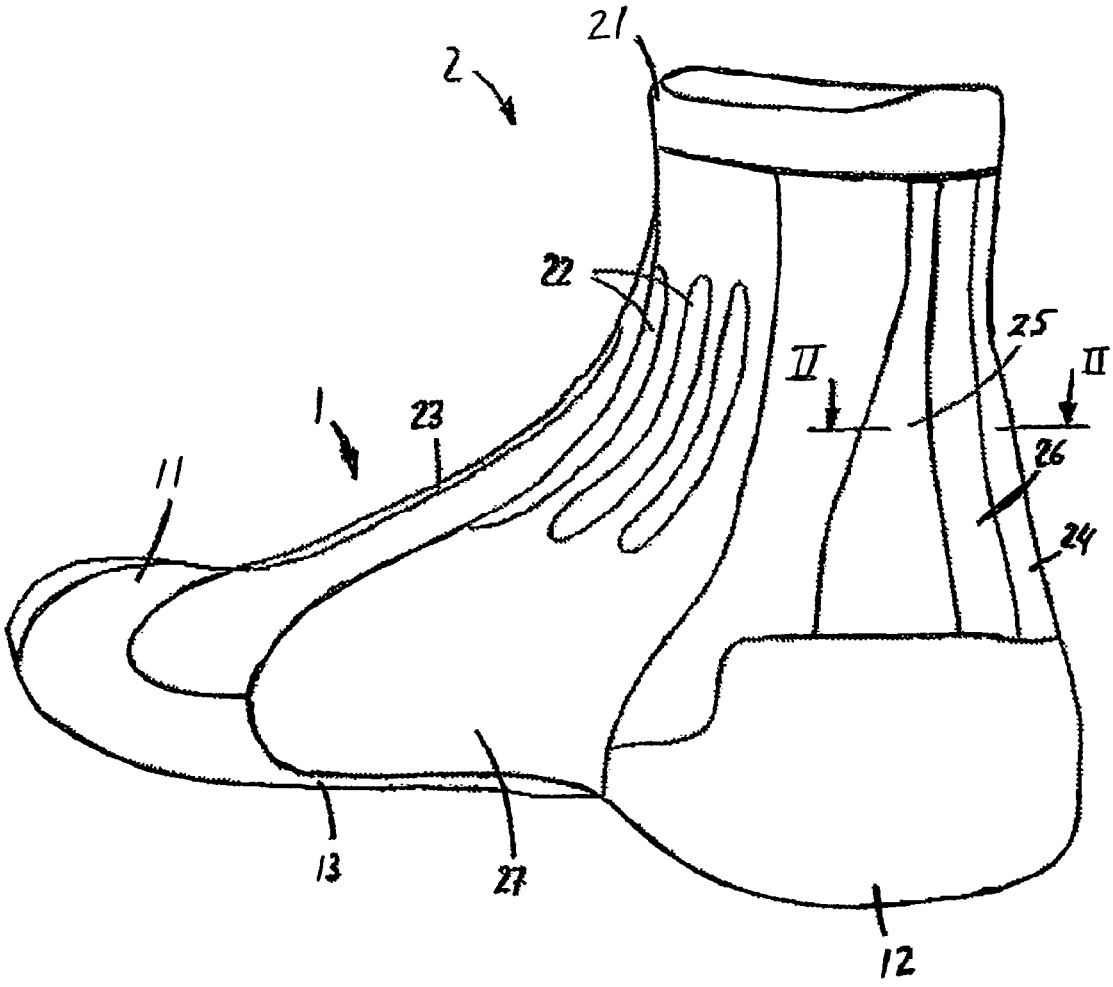
FIG. 1 is a perspective representation of the sock.

The sock selected as an example of implementation consists of a foot part (1) and a shaft (2). The foot part (1) has a toe area (11), a heel area (12), and a weight-bearing area (13) between the toe- and heel areas. The areas (11, 12, and 13) can, as depicted in the example of implementation, be made from reinforced material. The use of combinations of materials, such as virgin wool with elastomer fiber materials or elastane, for example, is also possible. The provision of additional cushion pads or paddings in the stated areas is also possible.

The shaft (2) is provided, on its end oriented away from the foot part (1), with a cuff (21). In the area of the ankle, the shaft (2) is provided with cushion pads (22), whereby bar-like cushion paddings are provided in the example depicted; other forms of cushion pads are possible. Cushion pads (23) forming a transition into the instep of the foot part are also positioned in the lower area of the shin.

Figure 2:
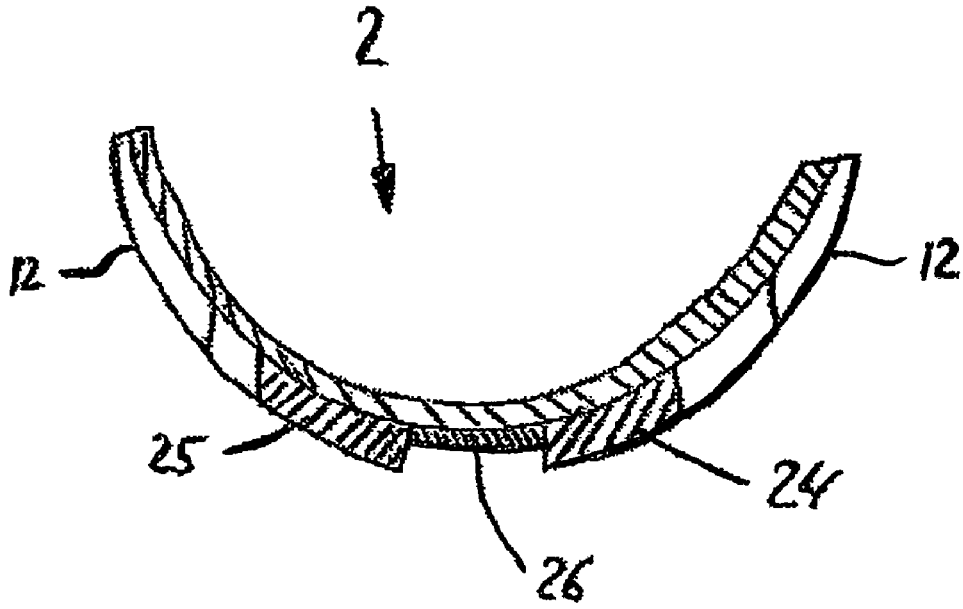
FIG. 2 is a section along the line II-II in FIG. 1.

In the area of the Achilles tendon, two spacer cushion pads (24, 25) are positioned on both sides of the Achilles tendon. In the example of implementation, the shape of the spacer cushion pads (24, 25) is adjusted to the anatomy of the foot in this area. The spacer cushion pads (24, 25) begin in the area of the heel, and end after tapering down to the cuff (21). A transition piece (26), which likewise extends between the heel area (12) and the cuff (21), and accommodates the Achilles tendon, is placed between the spacer cushion pads (24, 25). The transition piece (26) is made from climate—regulating fabric. The spacer cushion pads (24, 25) are designed in such a manner that they stand out distinctly relative to the transition piece (26) (FIG. 2) by extending outwardly from the outer surface of the sock. The spacer cushion pads (24,25) are thicker than the transition piece (26). By that means, it is guaranteed that the Achilles tendon has a sufficient distance from the surrounding footwear. Rubbing—and sliding effects are directly absorbed by the spacer cushion pads, without the Achilles tendon being stressed.

Furthermore, the sock can be equipped with an X-cross bandage—not depicted—, which is made from an elastic, climate-controlling fabric. The X-cross bandage supports the ankle in the transition area between the leg and foot.

In the example of implementation, an air channel (27), which extends up to the cuff (21) and is formed from a climate-regulating net-type knit fabric, extends away from the weight-bearing area (13). The air channel (27) contributes to the diversion of moisture upwardly and away from the weight-bearing area. Such an air channel (27) can also be provided in the sock on the inner side of the leg.

The cushion pads are generally produced from plastic threads, compound fabrics or threads, or similar materials. In the example of implementation, the cushion pads of the sock are produced from internally hollow fibers, which are surrounded by wool or cotton. The internally hollow plastic threads are particularly effective for providing pushing forces and reducing pressures. The weight-bearing area (13) can be made from knit microfibers, which helps to reduce abrasion. In the toe- and heel area, the bed of the foot is produced from microfibers, as needed.

Although the description and the claims refer to socks, the invention is not restricted to these alone; rather, stockings, pantyhose, and the like, to which the invention likewise relates, are also subsumed under this term. The spacer cushion pads thereby do not obligatorily need to be guided from the heel area up to the cuff.

I claim:

1. A sock, particularly for use in sporting activities, which has a cuff portion and a heel portion, a cushion padding in the area of the Achilles tendon, an inner surface facing the wearer's foot and an outer surface exposed to the environment, characterized in that, the cushion padding is formed from at least two spacer cushion pads, which are positioned on both sides of and along the Achilles tendon, and a transition piece extending from one spacer cushion pad to the other spacer cushion pad, and the spacer cushion pads are constructed and arranged to stand out distinctly relative to the transition piece, both the spacer cushion pads and the transition piece extending outwardly from the outer surface of the sock, the spacer cushion pads being constructed and arranged in the anatomical shape of the foot in the area of the Achilles tendon and tapering from the area of the heel portion to the cuff portion.

2. A sock in accordance with claim 1, characterized in that, the transition piece is designed in the form of a cushion pad which has a smaller thickness than the spacer cushion pads.

3. A sock in accordance with claim 2, characterized in that, the transition piece is produced from climate-regulating fabric.

4. A sock in accordance with claim 2, characterized in that, the spacer cushion pads are adjusted to the anatomical shape of the foot in the area of the Achilles tendon.

5. A sock in accordance with claim 2, characterized in that, the sock has an air channel.

6. A sock in accordance with claim 2, characterized in that, the sock has additional cushion pads.

7. A sock in accordance with claim 1, characterized in that, the transition piece is produced from climate-regulating fabric.

8. A sock in accordance with claim 1, characterized in that, the spacer cushion pads consist of internally hollow fibers, which are surrounded by wool or cotton.

9. A sock in accordance with claim 1, characterized in that, the sock has additional cushion pads.

10. A sock in accordance with claim 1, characterized in that, the sock has an air channel.

11. A sock in accordance with claim 1, characterized in that the spacer cushion pads consist of internally hollow fibers, which are surrounded by wool or cotton.

12. A sock in accordance with claim 1, characterized in that, the sock has additional cushion pads.

13. A sock in accordance with claim 1, characterized in that, the sock has an air channel.

14. A sock, particularly for use in sporting activities, which has a cuff portion and a heel portion, a cushion padding in the area of the Achilles tendon, an inner surface facing the wearer's foot and an outer surface exposed to the environment, characterized in that, the cushion padding is formed from at least two spacer cushion pads, which are positioned on both sides of and along the Achilles tendon, and a transition piece extending from one spacer cushion pad to the other spacer cushion pad, and the spacer cushion pads are constructed and arranged to stand out distinctly relative to the transition piece, both the spacer cushion pads and the transition piece extending outwardly from the outer surface of the sock, the spacer cushion pads being constructed and arranged in the anatomical shape of the foot in the area of the Achilles tendon and tapering from the area of the heel portion toward the cuff portion, said transition piece being a cushion pad having a smaller thickness than the spacer cushion pads, and said transition piece being made from climate regulating fabric.

* * * * *